US006910639B2

(12) United States Patent
Gartner

(10) Patent No.: US 6,910,639 B2
(45) Date of Patent: Jun. 28, 2005

(54) FUEL INJECTION DEVICE WITH MAGNET VALVE DAMPED IN BOTH LAMINAR AND TURBULENT FASHION

(75) Inventor: Bernhard Gartner, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 632 days.

(21) Appl. No.: 09/914,567

(22) PCT Filed: Dec. 22, 2000

(86) PCT No.: PCT/DE00/04587

§ 371 (c)(1),
(2), (4) Date: Mar. 20, 2002

(87) PCT Pub. No.: WO01/50008

PCT Pub. Date: Jul. 12, 2001

(65) Prior Publication Data

US 2002/0104905 A1 Aug. 8, 2002

(30) Foreign Application Priority Data

Dec. 31, 1999 (DE) ..... 199 63 922

(51) Int. Cl.[7] ..... B05B 17/00; B05B 1/30; F02M 47/02; F02M 61/00

(52) U.S. Cl. ..... 239/1; 239/88; 239/533.2; 239/533.3; 239/585.1; 239/585.3; 239/585.4; 239/585.5

(58) Field of Search ..... 239/88, 90, 89, 239/91, 96, 533.2, 533.3, 533.8, 533.9, 533.11, 533.14, 585.1, 585.3, 585.4, 585.5, 1; 251/129.15, 129.21, 127

(56) References Cited

U.S. PATENT DOCUMENTS

| | | | | |
|---|---|---|---|---|
| 4,646,976 A | | 3/1987 | Rembold et al. | |
| 4,918,925 A | * | 4/1990 | Tingle | 60/739 |
| 5,224,450 A | * | 7/1993 | Paul et al. | 123/292 |
| 5,280,773 A | * | 1/1994 | Henkel | 123/467 |
| 5,375,576 A | * | 12/1994 | Ausman et al. | 123/446 |
| 5,449,114 A | * | 9/1995 | Wells et al. | 239/5 |
| 5,651,501 A | * | 7/1997 | Maley et al. | 239/88 |

FOREIGN PATENT DOCUMENTS

DE WO 97 40272 A 10/1997

* cited by examiner

*Primary Examiner*—Davis Hwu
(74) *Attorney, Agent, or Firm*—Ronald E. Greigg

(57) ABSTRACT

A fuel injection device for internal combustion engines having a magnet valve that has a damping chamber and a relief chamber which communicate hydraulically through a damping throttle that damps in both laminar and turbulent fashion. As a result, the waviness of the characteristic curves of the fuel injection system is reduced and its function is improved.

13 Claims, 3 Drawing Sheets

FUEL INJECTION DEVICE WITH MAGNET VALVE DAMPED IN BOTH LAMINAR AND TURBULENT FASHION

CROSS-REFERENCE TO RELATED APPLICATIONS

This application is a 35 USC 371 application of PCT/DE 00/04587 filed on Dec. 22, 2000.

BACKGROUND OF THE INVENTION

1. Field of the Invention

The invention is based on a fuel injection device, having a magnet valve for controlling fuel flows, which valve, in at least one of its positions, closes a damping chamber in the magnet valve that communicates constantly with a relief chamber via a damping throttle.

2. Description of the Prior Art

A fuel injection device of the type with this invention is concerned is known from Published, Nonexamined German Patent Application DE-OS 196 16 084 A1, employs an insert piece with a through bore acting as a damping throttle between the damping chamber and the relief chamber. The damping performance of this through bore is not always satisfactory. Moreover, the installation space required for the insert piece is comparatively great.

OBJECTS AND SUMMARY OF THE INVENTION

The primary object of the invention is to furnish a fuel injection device with further improved performance.

According to the invention, this object is attained with a fuel injection device, having a magnet valve for controlling fuel flows, which valve, in at least one of its positions, closes a damping chamber in the magnet valve that communicates constantly with a relief chamber via a damping throttle, and in which the damping throttle throttles in both laminar fashion and turbulent fashion.

SUMMARY OF THE INVENTION

By this provision, the damping performance of the damping throttle can be adapted to the requirements of the fuel injection system within wider limits compared to the prior art. As a consequence, because of the use of the damping throttle of the invention, the waviness of the characteristic curves of a fuel injection device of the invention is decreased markedly. Furthermore, the characteristic curves of the fuel injection device of the invention become smooth. Both effects contribute to improving the performance of the fuel injection system. Furthermore, by the use of the damping throttle of the invention, the variations between different examples of a structurally identical fuel injection device are reduced, so that the variation in operating performance of internal combustion engines equipped with the fuel injection devices of the invention is reduced as well.

In a variant of the invention, it is provided that the damping throttle is embodied in a support plate, which is disposed between the damping chamber and the relief chamber and which closes off the damping chamber toward the relief chamber, so that a very compact design, because it is shallow in structure, is possible.

Further features of the invention provided that the turbulent throttle of the damping throttle is embodied in the form of a through bore that connects the damping chamber and the relief chamber, and in a further features, the through bore has a recess on at least one end, so that the throttling performance of the turbulent throttle can be adjusted within wide ranges to the particular demands of the fuel injection system. The adjustment is done by means of the diameter and length of the through bore, among other factors.

In a further feature of the invention the laminar throttle of the damping throttle is embodied in the form of a gap, so that under all possible operating conditions, the laminar damping performance is reliably achieved.

Features of the invention provide that the support plate, on its side toward the damping chamber, has at least one indentation, which with the magnet valve, in particular the electromagnet of the magnet valve, forms a gap, so that the gap can be produced in a simple way.

Further features of the invention provide that the indentation is round, that the indentation is disposed substantially concentrically with the through bore, that the indentation or indentations are grooves extending substantially radially to the longitudinal axis of the th rough bore, and that the thickness of the gap or the depth of the indentation or indentations is from 0.1 to 0.2 mm. As a result of these designs, especially good damping performance of the laminar throttle and the damping throttle overall can be attained. The use of a round indentation, with a depth of 0.1 to 0.2 mm and disposed substantially concentrically to the through bore has proved to be especially advantageous.

In a further feature of the invention, the indentation is disposed in such a way that it intersects at least one recess in the support plate, so that a communication always exists from the damping chamber to the relief chamber, via the gap formed by the indentation and the electromagnet and via the recess.

In a further feature of the invention, the support plate is mounted detachably in the fuel injection device, so that by simply replacing the support plate, the damping performance of the fuel injection device can be changed and improved.

BRIEF DESCRIPTION OF THE DRAWINGS

Further advantages and advantageous features of the invention can be learned from the ensuing description, taken with the drawings, in which.

DESCRIPTION OF THE PREFERRED EMBODIMENTS

Figure 1:
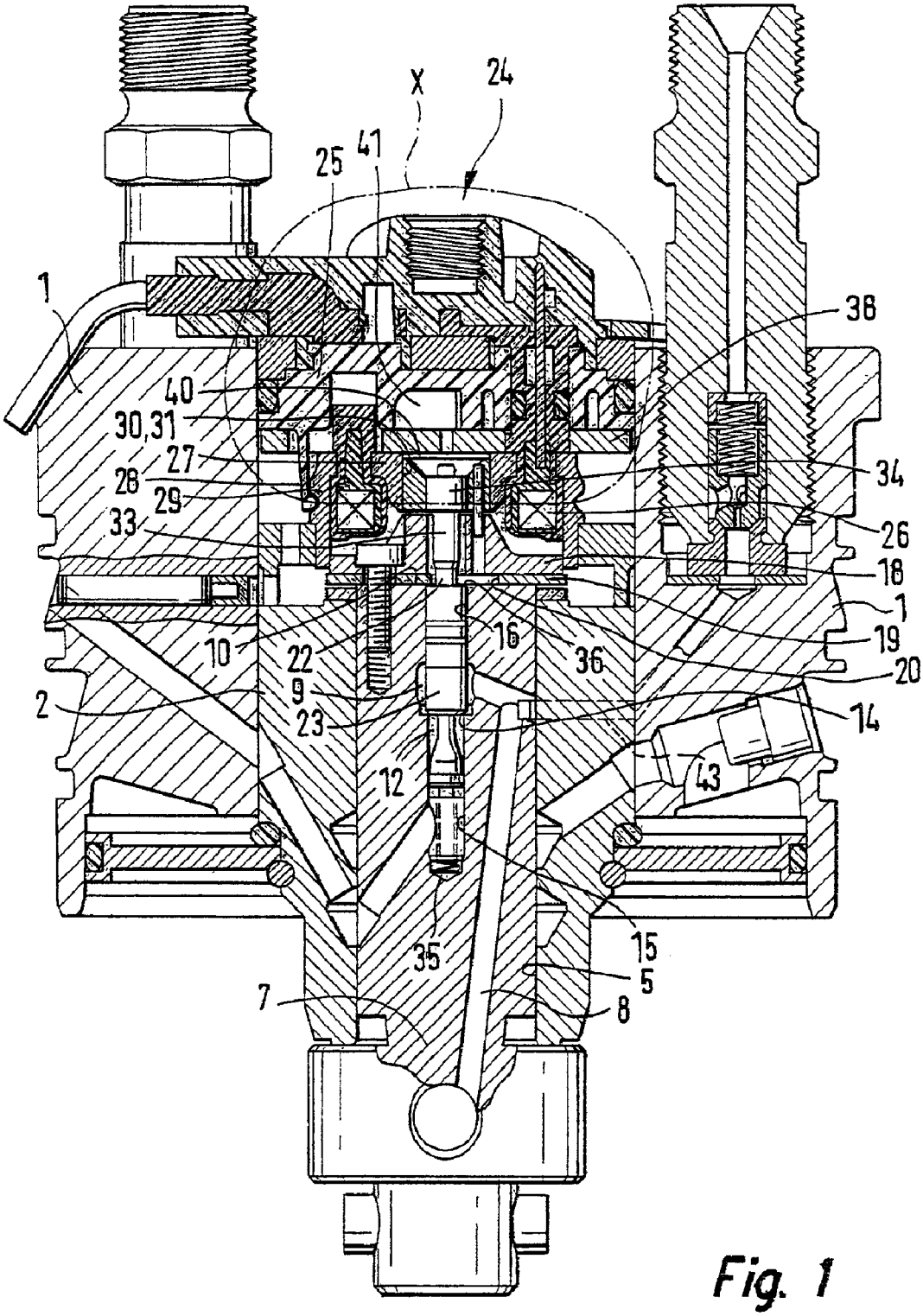
FIG. 1 is a cross section through a fuel injection device of the invention.

FIG. 1 shows part of a distributor injection pump, as a fuel injection device of the invention, in section. In a housing 1 of the fuel injection pump, a bush 2 is inserted, which in turn in its interior has a guide bore 5, in which a distributor 7 is guided. The distributor is driven to rotate by means not otherwise shown and revolves in synchronism with the rpm of an associated internal combustion engine. It is axially secured against displacement in the housing 1 and has a longitudinal conduit 8, which communicates on one side with a pump work chamber, not shown further here, and on the other side discharges into a pressure chamber 9, which is part of a conduit 12 that originates on one face end 10 of the distributor 7 and ends blind and is coaxial to the distributor. The pressure chamber 9 is defined on one side by a valve seat 14, which changes over into a partial bore 15 extending onward on the relief side of the conduit 12. The other side of the pressure chamber 9 is adjoined by a coaxial guide bore 16, which emerges at the face end 10 of the distributor 7.

A magnet disk 18 and a shim 19 are screwed onto this face 10. The shim 19 has a keyhole-shaped recess 20. A neck 22 of a valve member 23 of a magnet valve 24 protrudes through a narrow portion of the recess 20 that is coaxial to the distributor. The magnet valve is inserted with its housing 25 into the housing 1 of the fuel injection pump and is fixed there in stationary fashion. In its housing 25, the magnet valve 24 has an electromagnet 29 with a magnet coil 26, which is disposed inside a magnet core 27, which takes the form of a ring-shaped cup, with a middle, sleevelike magnet core 27 and an outer magnet jacket 28, between which and the middle magnet core 27 the magnet coil 26 is supported. On the face end toward the distributor 7, the magnet core 27 is supplemented with the magnet disk 18, which is adapted in diameter to the inside diameter of the outer magnet jacket 28 and with the latter forms only a narrow air gap. As a result, while the electromagnet 29 is stationary, the magnet disk 18, which is part of the magnetic circuit, can rotate together with the rotating distributor 7.

The middle magnet core 27 has a continuous recess 30, which serves as a guide 31 for a plunging armature 33. This armature is secured to a headlike end 34, adjacent to the neck 22 of the valve member 23, and upon excitation of the magnet coil 26, it actuates the valve member 23 to move in the closing direction onto its seat 14. Acting on the valve member 23 in the opening direction is a compression spring 35, which is supported in the partial bore 15. At the same time, the plunging armature 33 can also integrally form the headlike end 34 of the valve member 23.

The stroke of the valve member 23 is limited by the contact of a shoulder 36 of the valve member with the shim 19. The shoulder 36 is formed by the transition from the part of the valve member 23 that slides in the guide bore 16 to the neck 22.

A support plate 38 is located above the magnet coil 26. The support plate 38 contains a damping throttle, which connects a damping chamber 40, defined by the support plate 38 and the plunging armature 33, to relief chamber 41. The relief chamber 41 adjoins the support plate 38 on the far side thereof and communicates with fuel-carrying chambers of the fuel injection pump.

The support plate 38 can optionally be replaced to enable optimal adaptation of the damping throttle to the fuel injection system.

In operation of the fuel injection device, the valve member 23 is urged in the opening direction by the compression spring 35, so that the valve member 23 is lifted from its valve seat 14, and the pressure chamber 9 can be relieved toward the relief side. In this position of the magnet valve 24, high pressure cannot build up in the pump work chamber, not shown, and correspondingly high pressure cannot be carried to a fuel injection valve over one of a plurality of supply lines 43, which communicate in alternation with the pressure chamber 9 or the longitudinal conduit 8 upon rotation of the distributor.

When current is supplied to the magnet coil 26, a magnetic flux is created, which moves the plunging armature 33 toward the magnet disk 18 until the valve member 23 comes into contact with its valve seat 14. As already indicated, the stroke in the opening direction is limited by the contact of the shoulder 36 with the shim 19. The passage of the head 34 through the shim 18 makes the keyhole-shaped design of the recess 20 possible. In this respect, in a known manner, the head 34 of the valve member 23 is passed through an eccentrically located larger diameter, and then the neck 22 is positioned in the coaxial position to the distributor axis.

Figure 2:
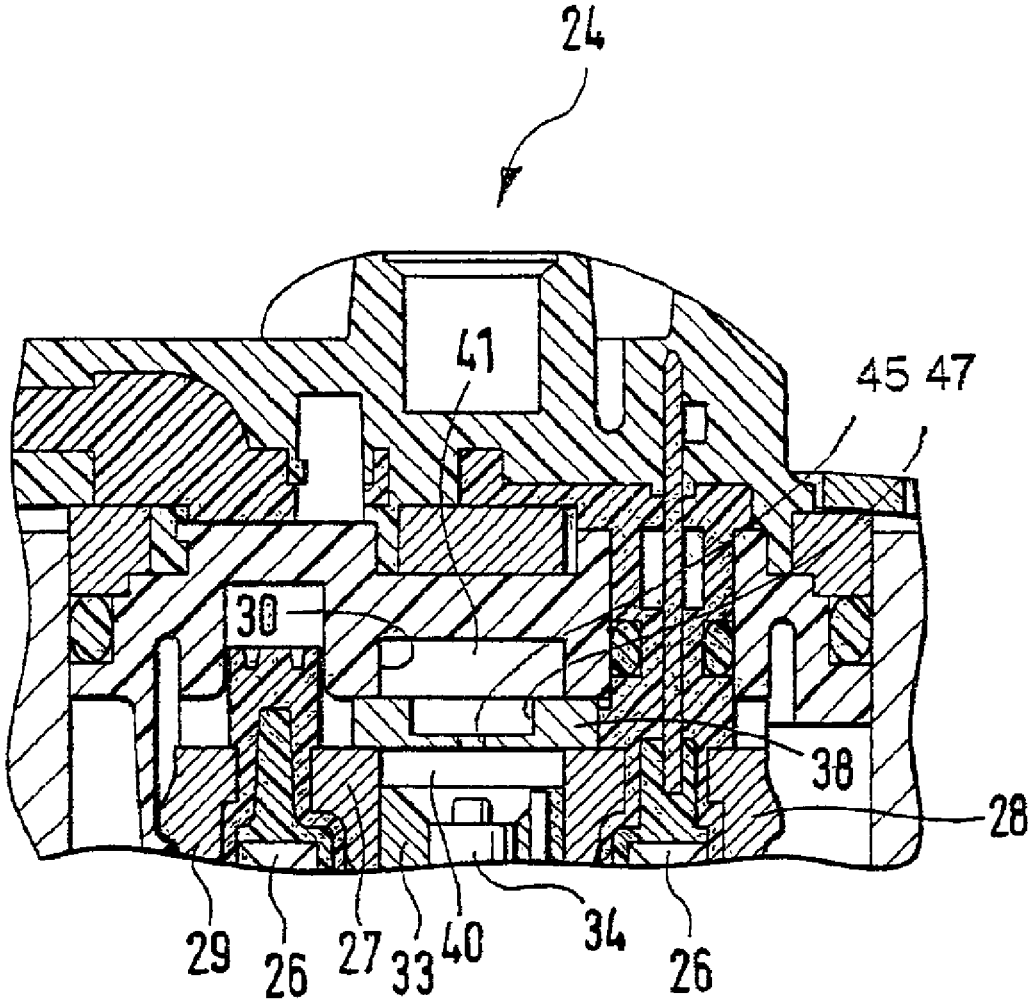
FIG. 2 is an enlarged view of the detail X of FIG. 1.

FIG. 2 shows an enlarged detail of the fuel injection device. In this view, the disposition of the support plate 38 between the damping chamber 40 and the relief chamber 41 is clearly shown. The support plate 38 has a through bore 45 acting as a turbulent throttle. By means of a countersunk recess 47, the through bore 45 is shortened, which can have an advantageous effect on the damping properties. The laminar throttle, which together with the aforementioned turbulent throttle forms the damping throttle of the fuel injection system, is not shown in FIG. 2.

Figure 3A:
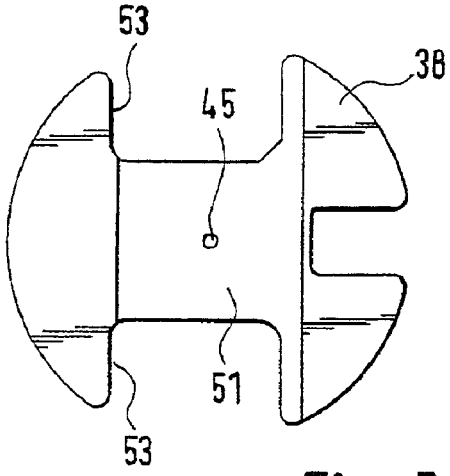
FIGS. 3*a*, 3*b* and 3*c* are a cross section and two views from below of a support plate.
Figure 3B:
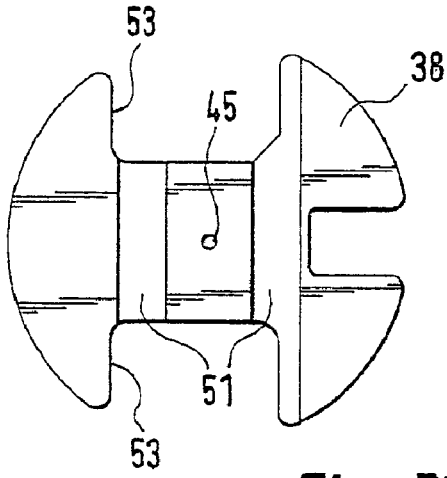
Figure 3C:
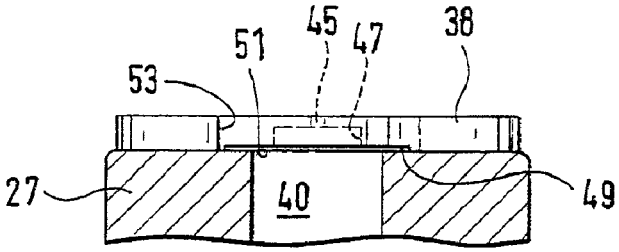

In FIG. 3*c*, a further detail of FIG. 2 is shown. The support plate 38 rests on the middle magnet core 27. Unlike FIG. 2, the countersunk recess 47 of the through bore 45 is disposed on the underside of the support plate 38. Between the support plate 38 and the middle magnet core 27, there is a gap 49 that is formed by an indentation 51 in the support plate 38. FIGS. 3*a* and 3*b* each show a view from below of a support plate 38 with variously shaped indentations 51.

In FIG. 3*b*, two parallel indentations 51 are provided. In FIG. 3*a*, a wide indentation 51 is provided. The indentations in FIGS. 3*a* and 3*b* extend between two recesses 53. Protruding through these recesses 53, in the built-in state of the support plate, are the plug contacts that supply current to the magnet valve. Also in the built-in state, the recesses 53 are in hydraulic communication with the relief chamber 41, so that via the gap 49 and the recesses 53, fuel can flow out of the damping chamber 40 into the relief chamber 41. In FIGS. 3*a* and 3*b*, the countersunk recess 47 is not shown.

Figure 4A:
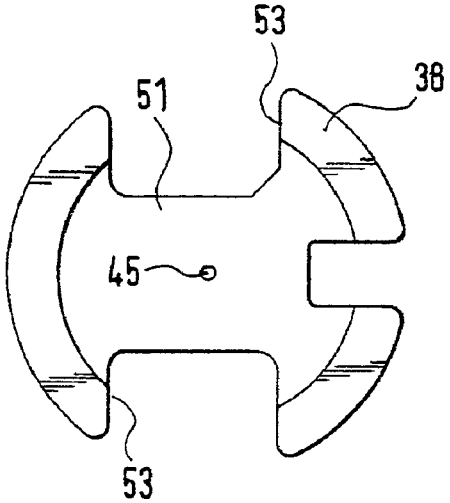
FIGS. 4*a* and 4*b* are two further views from below of a support plate.
Figure 4B:
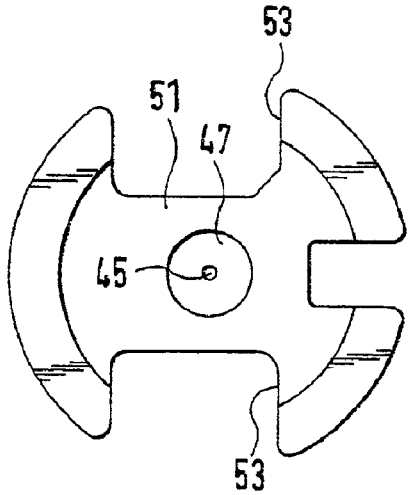

Further views of support plates 38 from below are shown in FIGS. 4*a* and 4*b*. In these versions, the indentations 51 are circular, which has proved to be especially advantageous. The countersunk recess 47 is shown in FIG. 4*b*.

With the fuel injection device described above and the associated magnet valve, an exact fuel quantity control is obtained, in particular in the case contemplated here in which, with the aid of the magnet valve, the high-pressure pumping phase along with the injection onset and injection duration of the fuel injection pump is determined. Via the rotating distributor, and via a respective supply line 43, the associated fuel injection valve is triggered and supplied with the high-pressure injection quantity controlled by the magnet valve 24. With only slight mass, the magnet valve is very fast and vibration-free, with the optimally adaptable damping contemplated here.

The foregoing relates to preferred exemplary embodiment of the invention, it being understood that other variants and embodiments thereof are possible within the spirit and scope of the invention, the latter being defined by the appended claims.

What is claimed is:

1. A fuel injection device, comprising a magnet valve (24) for controlling fuel flows, which valve, in at least one of its positions, closes a damping chamber (40) in the magnet valve (24) that communicates constantly with a relief chamber (41) via a damping throttle, said damping throttle being adapted to throttle in both laminar fashion (49) and turbulent fashion (39), wherein said damping throttle is embodied in a support plate (38), which support plate is disposed between the damping chamber (40) and the relief chamber (41) and which closes off the damping chamber (40) toward the relief chamber (41).

2. The fuel injection device of claim 1, wherein said turbulent throttle (39) of the damping throttle is embodied in the form of a through bore (45) that connects the damping chamber (40) and the relief chamber (41).

3. The fuel injection device of claim 2, wherein said through bore (45) has a countersunk recess (47) on at least one end.

4. The fuel injection device of claim 3, wherein said support plate (38), on its side toward the damping chamber (40), has at least one indentation (51), which with the magnet valve (24), in particular the electromagnet (29) of the magnet valve (24), forms a gap (49).

5. The fuel injection device of claim 2, wherein said support plate (38), on its side toward the damping chamber (40), has at least one indentation (51), which with the magnet valve (24), in particular the electromagnet (29) of the magnet valve (24), forms a gap (49).

6. The fuel injection device of claim 1, wherein said laminar throttle of the damping throttle is embodied in the form of a gap (49).

7. The fuel injection device of claim 6, wherein the thickness of said gap (49) is from 0.1 to 0.2 mm.

8. The fuel injection device of claim 1, wherein said support plate (38), on its side toward the damping chamber (40), has at least one indentation (51), which with the magnet valve (24), in particular the electromagnet (29) of the magnet valve (24), forms a gap (49).

9. The fuel injection device of claim 8, wherein said indentation (51) is round and is disposed substantially concentrically with the through bore (45).

10. The fuel injection device of claim 8, wherein said indentation (51) or indentations (51) are grooves extending substantially radially to the longitudinal axis of the through bore (45).

11. The fuel injection device of claim 8, wherein said indentation (51) intersects at least one recess (53) in said support plate (38).

12. The fuel injection device of claim 8, wherein the depth of the indentation (51) or indentations (51) is from 0.1 to 0.2 mm.

13. The fuel injection device of claim 1, wherein said support plate (38) is mounted detachably in the fuel injection device.

* * * * *